United States Patent [19]

Hartley

[11] 4,116,332

[45] Sep. 26, 1978

[54] COMBINATION BRUSH HOLDER AND CAN CONNECTOR

[76] Inventor: Daniel W. Hartley, 1829 Moss Tree Rd., North Charleston, S.C. 29406

[21] Appl. No.: 708,127

[22] Filed: Jul. 23, 1976

[51] Int. Cl.[2] ..... B65D 81/24

[52] U.S. Cl. ..... 206/209; 206/361; 206/508; 206/821; 211/65; 220/90

[58] Field of Search ..... 206/1.7, 15.2–15.3, 206/209, 216, 361, 508, 527, 821; 211/65–66; 220/85 R, 90; 248/110

[56] References Cited

U.S. PATENT DOCUMENTS

| | | | |
|---|---|---|---|
| 1,471,712 | 10/1923 | Sohnle | 211/65 |
| 1,629,213 | 5/1927 | Hughes | 206/209 X |
| 1,949,912 | 3/1934 | Johnson | 206/209 X |
| 2,562,496 | 7/1951 | Kirsch | 220/90 X |
| 2,945,251 | 7/1960 | Eichner | 211/65 X |
| 3,156,364 | 11/1964 | Wolcott | 206/209 X |
| 3,317,087 | 5/1967 | Landis | 206/821 X |
| 3,727,792 | 4/1973 | Levin | 220/90 |

FOREIGN PATENT DOCUMENTS

| | | | |
|---|---|---|---|
| 826,430 | 1/1960 | United Kingdom | 206/209 |

*Primary Examiner*—Steven E. Lipman

[57] ABSTRACT

A combination brush holder and can connector including a holder for brushes, such as paint brushes, which is supported for vertical adjustment on a connector by means of which two cans, such as paint cans of conventional construction, are coupled together in sealing engagement with the cans arranged in vertically stacked, inverted relationship with the holder supporting the brush within the interior of the cans so that the brush bristles are immersed in the paint at any level contained in the bottom can.

6 Claims, 4 Drawing Figures

FIG. 1
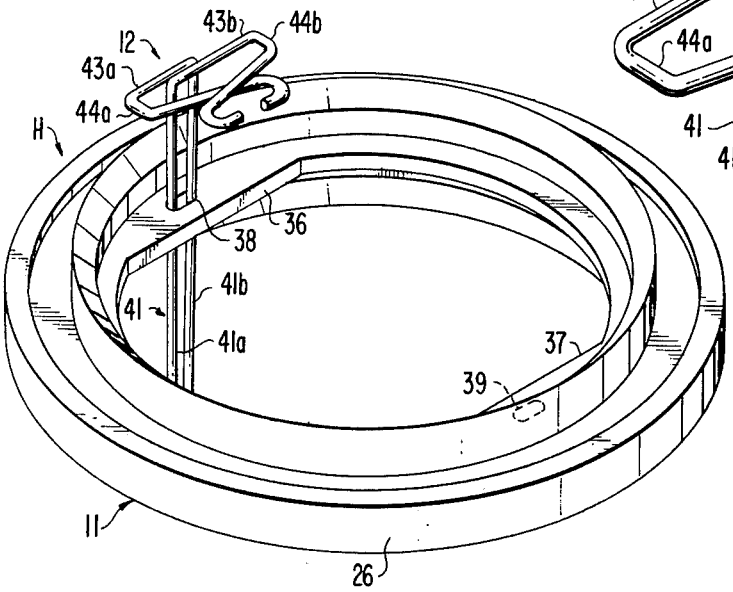
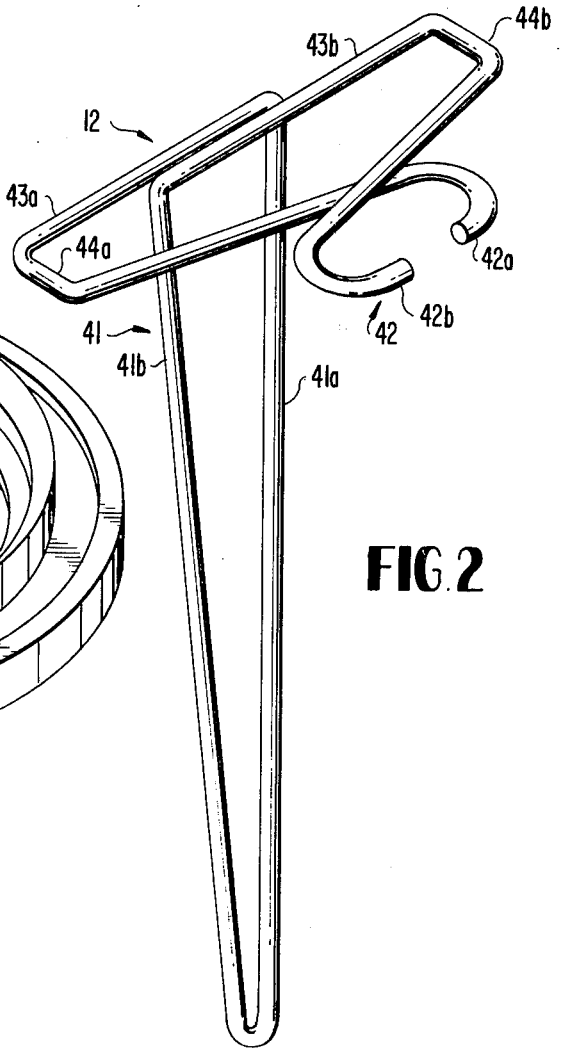
FIG. 2
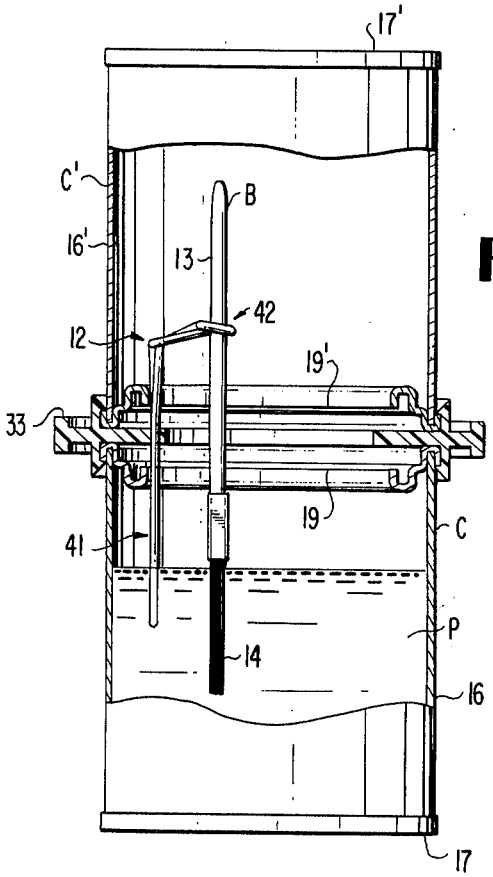
FIG. 3
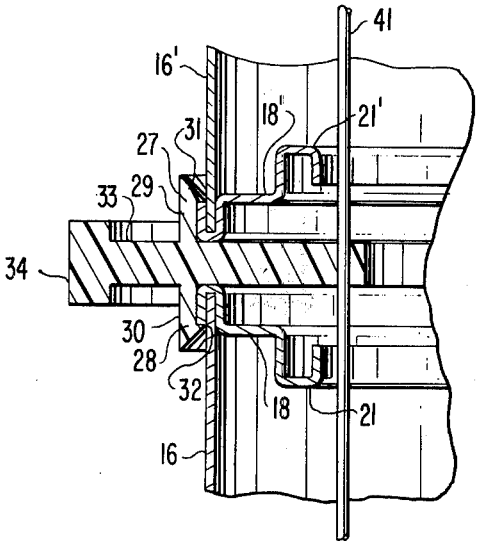
FIG. 4

COMBINATION BRUSH HOLDER AND CAN CONNECTOR

BACKGROUND OF THE INVENION (1) Field of the Invention

This invention relates to apparatus for maintaining a paint brush in useable condition without having to clean it between uses. More particularly, this invention relates to a can connector fitting the rim of a paint-containing can and having a brush holder supported therein and means for securing an inverted empty can on top of the connector.

One of the most annoying problems encountered by painters, especially painters of the amateur or "do-it-yourself" category, is the cleaning of brushes after a painting operation. While substantial technical progress has been made in paint compositions, bristle material, etc., the cleaning of paint brushes after use still remains a tedious and messy operation. In addition, regardless of the efforts expended in cleaning brushes of paint, much of the texture and effectiveness of a new brush is invariably lost. the brush cleaning operation is less troublesome to a professional painter who uses his paint brushes regularly thereby maintaining his brushes in fairly good condition throughout their useful life. However, in the case of the amateur painter, such as the homeowner, only occasional use is made of his paint brushes so that thorough cleaning of the brush is required after each use to put the brush in condition for the next painting operation. In addition, it is seldom that the amateur painter is able to make more than partial use of the paint in a container or can purchased for a particular painting operation so that it is quite common for the typical homeowner to accumulate a substantial number of cans containing paint at various levels due to such partial use.

(2) The Prior Art

In order to clean the brushes as well as to keep the bristles supple for the prolonged periods between use, it has been proposed to provide suitable brush supports which may be suitably attached to a receptacle containing a solvent so as to support the brush on the receptacle with the brush bristles immersed in the solvent between periods of use. Exemplary of such prior art attempts to provide brush holders in covered solvent-containing receptacles are U.S. Pat. No. 3,156,364 to Wolcott and U.S. Pat. No. 2,533,355 to Comfort. Not only does such an arrangement usually require a special receptacle, but solvent is expensive as well as generally failing to maintain the brush bristles at the desired degree of suppleness and to avoid sticking together of the bristles. Furthermore, with the ready evaporation of solvent together with the lack of adjustability in brush holders, it is difficult if not impossible to maintain the bristles completely immersed in the solvent, particularly in view of the variety of brush sizes used by the typical painter. Even where closures for the solvent receptacles have been provided which permit the brush to remain in the receptacle, special constructions are required which are complicated, bulky and expensive as well as being somewhat ineffective in producing the desired result.

As the subject invention contemplates the use of a brush holder vertically disposed through the can connector, it should be appreciated that the prior art replicate with various designs of wire-type brush holders for attachment to the side of an uncovered can. Exemplary of the wire-type brush holders include; U.S. Pat. No. 2,450,736 to Pierce, U.S. Pat. No. 2,489,875 to Embree, U.S. Pat. No. 2,184,667 to Hannan, U.S. Pat. No. 1,125,931 to Arnest, and U.S. Pat. No. 955,646 to Jorey. These patents are cited as exemplary only and are not intended to be all inclusive of the prior art.

Accordingly, the general object of this invention is to provide a combination brush holder and connector for cans, such as paint cans of the type in widespread commercial use today.

Another object of this invention is to provide a combination brush holder and connector for cans, such as paint cans which permits a paint brush to be supported with its bristles immersed in paint remaining in the paint can regardless of the paint level so as to maintain the bristles in proper condition throughout prolonged periods between painting operations.

A further object of this invention is to provide a combination paint brush holder and connector for paint cans which not only may be used to support a paint brush of any size with its bristles immersed within the paint remaining after use in the original can, but which utilizes another identical can of conventional type as a closure for the original can thereby sealing both the remaining paint and brush in a substantially air-tight enclosure.

This invention further contemplates the provision of a combination brush holder and connector for cans, such as paint cans, which enables the elimination of the bristle cleaning operation following a painting operation and attendant deterioration of the bristles, and which eliminates the use of solvent for brush cleaning and bristle maintaining purposes, and which utilizes conventional paint cans in common use today. It should not be overlooked that the brush holder and connector can be used to suspend brushes in a solvent following a painting operation.

Still another object of this invention is to provide a paint brush holder and connector for paint cans which is simple and inexpensive in construction, which is lightweight and highly resistant to damage so as to be capable of prolonged use without deterioration, which utilizes readily available inexpensive materials and in which the connector may be formed by conventional molding operations at a high production rate.

Other objects, features and advantages of the invention will become apparent from the following detailed description taken in connection with the accompanying drawings.

BRIEF DESCRIPTION OF THE DRAWINGS

FIG. 1 is a perspective view of the combination brush holder and can connector constructed in accordance with the invention.

FIG. 2 is a front elevation view of the brush holder component of the device of FIG. 1.

FIG. 3 is a side elevation view partially broken away showing the device of FIG. 1 in the operation position.

FIG. 4 is an enlarged sectional view of a portion of the structure of FIG. 3.

SUMMARY OF THE INVENTION

In general, the objects of this invention are accomplished by providing an annular body member of substantially T-shaped, cross-sectional area including upper and lower vertically aligned annular flanges, the inner side wall of which defines a central opening. The body member also includes an annular side flange extending radially outward from the outer side wall and at least one support flange is provided on the inner side wall extending radially inward. A brush holder having an elongated body portion and a brush retaining portion is supported for vertical adjustment on the support flange to position a brush attached to the brush retaining portion in a selected vertical position. The upper and lower body member flanges are receivable in snug-fitting, sealing engagement with the outer edges of the rims of substantially identical top and bottom cans respectively with the cans arranged in vertically stacked, co-axially aligned, inverted relationship to thereby enclose a brush supported on the brush holder within the interior of the cans.

DETAILED DESCRIPTION OF THE INVENTION

Referring to the drawings and to FIG. 1, in particular, there is shown a combination brush holder and can connector constructed in accordance with the invention and designated generally by the numeral 10. The combination brush holder and connector 10 includes a can connector designated generally by the numeral 11 on which is supported for vertical adjustment a brush holder designated generally by the numeral 12 as will be explained hereinafter. As shown best in FIG. 3, the device 10 of FIG. 1 may be used for supporting any suitable brush within the interior of any suitable containers and, in the preferred embodiment, is particularly adapted for supporting a paint brush of the well known type, such as a brush B having a handle 13 and bristles 14 within the interior of a pair of paint cans of the well-known type which are identified by the letters C, C'.

The cans C, C' illustrated in FIG. 3 with which the invention is associated are identical in construction; and only the parts of can C will be described in detail, like numerals being employed to identify like parts in can C'. As is well known, can C, which is preferably formed of metal or the like, includes a tubular body 16 closed at one end by an end panel 17 forming a bottom wall and having an annular flange or rim 18 at the other end suitably secured to the end edge of the tubular body 16 and extending radially inward to define an access opening 19. The rim 18 is provided with an annular recess 21 which, as is well known, is arranged to accommodate the annular flange of an end closure (not shown) for the can C. As shown in FIG. 3, the can C is of the type in widespread use today for the packaging of paint P, the level of paint P in FIG. 3 being somewhat lower than that of a full can for representing the paint level following the use of a portion of paint in the can C.

Referring now to FIG. 1, the can connector 11 is an annular body member 26 of substantially T-shaped cross-sectional area as shown best in FIG. 4 which includes upper and lower vertically aligned annular flanges 27, 28, outer side walls 29, 30 and inner side walls 31, 32 defining means for securing the annular body member to the lower and upper cans. Lips are provided on inner flange walls 31, 32 to assure a secure fit with can rims 18, 18'. The edge 34 of annular body member 26 is preferably slightly raised for easy grasping to remove the connector from the can. The body member 26 also includes an annular side flange 33 which extends radially outward from the outer side walls 29, 30, raised. Although the body member 26 may be formed of any suitable material, such as metal or the like, in the preferred embodiment, the body member is formed in a one-piece construction from synthetic resinous material, such as polyethylene, polystyrene or the like, using any well known plastic molding operation.

At least one support flange is provided on the inner side wall 31 of the body member 26 which extends radially inward within the central opening 50. More specifically, a pair of support flanges 36, 37 are provided on the body member 26 which are preferably of segmental shape and which are arranged in diametrically opposed relationship as shown best in FIG. 1. It would be understood that a single circumferentially extending flange may be provided on the body member 26 but, in the illustrated embodiment, segmental flanges 36, 37 are provided for conservation of space in order to avoid reduction in the size of the central opening 50. Means are provided on the support flanges 36, 37 for supporting the brush holder 12 for vertical adjustment as will be explained hereinafter and, in the illustrated embodiment, the supporting means includes apertures 38, 39. In addition to support of brush holder 12, flanges 36, 37 are relatively flat and serve to provide a suitable surface for removing excess paint from brushes when the painting operation is resumed after a stoppage.

The brush holder 12 includes an elongated body portion 41 and a brush retaining portion 42 for yieldable supporting engagement with the brush handle 13 as shown in FIG. 3. In the illustrated embodiment, the brush holder 12 is of one-piece wire construction whereby the body portion 41 comprises a folded spring wire member of substantially V-shaped configuration to provide a pair of yieldable leg portions **41*a*, 41*b* as shown best in FIG. 2. The brush retaining portion 42 includes wire extensions 42*a*, 42*b* on each of the leg portions 41*a*, 41*b* respectively arranged in laterally extending relationship therewith to form a pair of spring fingers arranged in substantially parallel relationship for yieldingly engaging a brush handle 13 in brush supporting relationship. Outer arms 43*b*, 43*a* cross leg portions 41*a*, 42*b* so that when the ends 44*b*, 44*a* of outer arms 43*b*, 44*a* are squeezed together brush retaining portions 42*a*, 42*b* spread apart for easy insertion or removal of the paint brush. Outer arm ends 44*a* and 44*b*** are preferably slightly extended forward to provide ease of gripping.

As shown best in FIG. 1, the folded wire member or brush holder body portion 41 is slidably receivable vertically within one of the apertures 38, 39 of the support flanges 36, 37 respectively thereby permitting yielding movement towards each other of the leg portions **41*a*, 41*b* from the relaxed condition of FIG. 2 thereby yieldingly retaining the body portion 41 in a selected vertical position in the aperture. It will be noted that when the leg portions 41*a*, 41*b* move towards each other as the body portion 41 is inserted in one of the apertures 38, 39, the jaw 42*a*, 42*b* are similarly moved apart to increase the gap between the extensions into which the brush handle 13 is to be inserted. In the preferred embodiment, each of the spring fingers or jaw 42*a*, 42*b* is more or less circular in configuration and is arranged in oppositely directed relationship for readily accommodating the brush handle 13** in the brush supporting relationship.

In the use of the invention, following a painting operation in which the paint level in the original can C has been lowered to a level such as shown in FIG. 3, the body portion 41 of the brush holder 12 is inserted in the aperture 38 of support flange 36 as shown in FIG. 1 and the brush handle 13 inserted between the spring jaws 42a, 42b within the circular portions so as to hang vertically as shown in FIG. 3. As will be appreciated, pointed ends of 42a, 42b serve to pinch brush handle 13 limiting any downward movement of the brush B from its predetermined position. The brush holder 12 may then be moved vertically by sliding the body portion 41 within the support flange aperture 38 until the brush bristles 14 are completely immersed in the paint P.

The connector 11 with the brush holder 12 positioned thereon as shown in FIG. 1 is positioned on the can C, hereinafter referred to as the bottom can, by inserting the lower annular flange 28 of the body member 26 in the can annular recess 21. Then, an empty can C′ herein referred to as the top can is positioned in vertically stacked, co-axially aligned, inverted relationship with the bottom can C by pushing the can C′ downwardly so that the upper flange 27 of the body member 26 is received in snug-fitting, sealing engagement within the top can annular recess 21′. Thus, the interiors of the cans C, C′ surrounding the paint P and brush B are sealed from the outside air preserving the paint P in its original condition throughout the shelf life of the paint. At the same time, the immersion of the brush bristles 14 in the paint P maintain the bristles in substantially the original condition ready for the next painting operation since there is no drying of paint or deteriorating attack by solvents or the like on the bristles.

It will be noted the body member side flange 33 extends radially outward between the adjacent ends of the stacked cans C, C′ as shown in FIG. 4 thereby providing a lever for ready manipulation by the painter for separation of the can C, C′ when the brush B and paint P are to be used for a subsequent painting operation. Although, in the illustrated embodiment of the invention, the invention is particularly adapted for use with conventional paint cans C′ provided with annular rims 18, 18′ respectively, the invention is also suitable for use with any type of paint can in commercial use today, as it can be snugly fitted in air-tight relationship by flanges 27, 28 having lips 31, 32.

It can be seen that there has been provided with the novel arrangement of the invention a holder for a paint brush which permits the brush to be supported immediately after use in the original paint can with its bristles completely immersed in the paint remaining in the can regardless of the paint level. Not only is the brush holder simple and inexpensive in construction being composed only of a single wire member suitably bent into the configuration of the invention but vertical adjustment of the brush position is obtained in a simple and easy manner on a can connector which is positioned in sealing engagement with both the original paint can and an identical empty can reversely positioned on the original can and in sealing relationship therewith to thereby provide an air-tight enclosure for both the brush and the paint remaining in the original can.

The invention eliminates brush cleaning, deterioration of the brush bristles, hardening of the paint remaining in the original can through the shelf life of the paint and the paint brush remains immediately available for instant use in a painting operation regardless of the period of time between uses. An outstanding feature of the invention is the elimination of the need for special receptacles since the invention is adapted for use with cans of the type in universal use today for the packaging of paint. Not only is the combination brush holder and can connector of the invention particularly advantageous to the amateur painter whose painting operations are generally performed only intermittently, but the same problems overcome by the invention at least occasionally confront the professional painter who is fully able to take advantage of the novel results which the invention provides.

While there has been described what at present is considered to be the preferred embodiment of the invention, it will be understood by those skilled in the art that various changes and modifications may be made therein without departing from the invention.

Having thus described the invention, what is claimed is:

1. A combination brush holder and connector for cans of the type having a tubular body closed at one end and provided at the other end with an annular rim defining an access opening comprising, in combination;

(a) an annular body member of substantially T-shaped cross-sectional area, said body member including upper and lower vertically aligned annular flanges, an outer side wall, an inner side wall defining a central opening and an annular side flange extending radially outward from said outer side wall, at least one support flange on said inner side wall extending radially inward within said central opening, said upper and lower flanges being receivable in snug-fitting, sealing engagement within the outer rim of the top and bottom can respectively of a pair of cans arranged in vertically stacked, co-axially aligned, inverted relationship with said can access openings in adjacent relationship and with said body member side flange extending radially outward between the adjacent other ends of said stacked pair of cans, and (b) a brush holder having an elongated body portion and a brush retaining portion for yieldable supporting engagement with a brush having a handle and an aperture in said support flange for supporting said body portion for vertical adjustment to position a brush having a handle supported on said retaining portion in a selected vertical position within said vertically stacked cans, said brush holder body portion comprises, a folded spring wire member of substantially V-shaped configuration to provide a pair of yieldable leg portions, said folded wire member being slidably receivable vertically within said aperture for yielding movement of said leg portions towards each other for retaining said wire member in said selected vertical position in said aperture.

2. The combination brush holder and connector in accordance with claim 1 wherein said body member and said support flange are formed integrally in a one-piece construction of synthetic resinous material.

3. The combination brush holder and connector in accordance with claim 1 wherein said support flange is of segmental shape.

4. The combination brush holder and connector in accordance with claim 3 wherein a pair of said support flanges are provided on said inner side wall, each of said support flanges being of segmental shape having an aperture and arranged in diametrically opposed relationship and wherein each of said spring jaws is provided with a circular portion in oppositely directed relationship for accommodating said brush handle in said brush supporting relationship.

5. The combination brush holder and connector in accordance with claim 1 wherein said brush holder is of one-piece wire construction and wherein said brush retaining portion includes an extension on each of said leg portions and in laterally extending relationship therewith to form a pair of spring jaws arranged in substantially parallel relationship for yieldingly engaging said brush handle in said brush supporting relationship.

6. The combination brush holder and connector in accordance with claim 1 wherein the upper and lower flanges of said connector have inwardly disposed lips to insure snug fitting of the outer rims of said top and bottom cans.

* * * * *